US005333736A

United States Patent [19]

Kawamura

[11] Patent Number: 5,333,736

[45] Date of Patent: Aug. 2, 1994

[54] SELF-SEALING COMPRESSION PACKAGING BAG AND COMPRESSION PACKAGING BAG

[75] Inventor: Yoshihisa Kawamura, Tokyo, Japan

[73] Assignee: VIP Kokusai Kyumei Center, Inc., Tokyo, Japan

[21] Appl. No.: 974,739

[22] Filed: Nov. 13, 1992

[30] Foreign Application Priority Data

Nov. 14, 1991 [JP] Japan ..... 3-101331

[51] Int. Cl.[5] ..... B65D 81/20

[52] U.S. Cl. ..... 206/524.8; 206/223

[58] Field of Search ..... 206/216, 223, 524.8; 383/210

[56] References Cited

FOREIGN PATENT DOCUMENTS 036655 9/1981 European Pat. Off. ..... 206/524.8
1-99925 4/1989 Japan .
1-111618 4/1989 Japan .
3-98856 4/1991 Japan .
3-81852 8/1991 Japan .
4-89747 8/1992 Japan .

*Primary Examiner*—William I. Price
*Attorney, Agent, or Firm*—Fish & Richardson

[57] ABSTRACT

A self-sealing compression packaging bag for compression sealing of an article on evacuation and a compression packaging kit using the bag. Clothing is introduced at an opening part of a bag formed of a film material exhibiting self-adherent properties and provided with an evacuating port. An evacuating tube is introduced into the evacuating port and the inside of the bag is evacuated through the tube by a vacuum pump. The opening part is automatically sealed at this time, and the evacuation port is automatically sealed on extracting the evacuating tube. Tight sealing of the bag may be achieved automatically on evacuation without the need for heat compression bonding. Also, the bag is portable.

12 Claims, 4 Drawing Sheets

SELF-SEALING COMPRESSION PACKAGING BAG AND COMPRESSION PACKAGING BAG

BACKGROUND OF THE INVENTION

1. Field of the Invention

This invention relates to a compression packaging bag for compression sealing of clothing or the like on evacuation after previously introducing the wearing apparel into the bag. More particularly, it relates to a self-sealable compression packaging bag and a compression packaging kit employing the bag.

2. Related Art

An evacuation type compression packaging bag is adapted for compression packaging bulky articles, such as bedquilt or clothes, and holding them in such packaged state. After the articles are accommodated in an non-permeable bag, the inside of the bag is evacuated by a suction pump, such as a vacuum pump or an electric cleaner for household use via a suction port. At this time, the inside of the bag is compressed automatically under the atmospheric pressure. After compression, an opening part is sealed, such as with a heat compression sealing, for maintaining the bag in the evacuated and compressed state. The bag material employed for this purpose is generally a heat compression sealing type film material. This type of packaging bag is disclosed in JP Utility Model KOKAI Publication Hei-3-81852 by the present Assignee (Date of KOKAI Publication, Aug. 21, 1991).

DISCUSSION OF THE RELATED ART

In the above-mentioned compression packaging bag, a predetermined heat compression sealing operation is indispensable because such sealing is necessary to perform sealing the opening part after evacuation. Although a special heat compression sealing equipment may be provided for professional users, it is not practical to provide such equipment in households. Although a flatiron is widely used for heat compression sealing, it takes some time after completion of evacuation until completion of heat compression sealing. Since the evacuated state may be destroyed during this time, elaborate attention needs to be exercised for completing the heat compression sealing, such that, if the user is not skilled in the operation, heat sealing may not be successful.

At any rate, a heat compression sealing step is indispensable for sealing the bag in the conventional process, which has proven to be a hindrance to more common use of the compression packaging bag.

Since, heat compression sealing is needed in the conventional process, the use of the compression packaging bag is not versatile. Its use is limited to packaging of large-sized articles, such as bedding, inclusive of bedquilt, or clothing. In other words, the conventional bag is difficult to handle.

OBJECTIVES AND SUMMARY OF THE INVENTION

It is an object of the present invention to overcome the above-mentioned deficiencies in the prior art bag and to provide a simplified evacuation type compression packaging bag which does not need a heat compression sealing system.

It is a more specific object of the present invention to provide a portable small-sized evacuation type compression packaging bag having a simplified structure which is easily used to accommodate clothing in a suitcase for trip or the like.

Further objectives of the invention will become apparent in the disclosure.

In accordance with the present invention, a self-sealing compression packaging bag having an opening part and an evacuating port, is comprised of a film material exhibiting self-adherent properties, as a sealing means, on at least the inner surface of the opening part and in a portion of the evacuating port (basic structure).

Since at least the inner surface of portions of the opening part and the evacuation port are self-adherent, bag halves are tightly bonded to each other at the opening part and the evacuating port by evacuation for self-sealing. Thus, the desired compression state may be maintained without a need for heat compression sealing as in the conventional practice. Above all, for evacuation, tight sealing of the evacuating port may be maintained by simply extracting an evacuating tube.

Based on the above described fundamental concept of the present invention, additional features of the invention will be explained. The evacuating port is opened on an outer edge of the bag and extends into the interior of the bag. It is openably defined between a pair of connected parts of bag halves comprised of both bag sides, so that the evacuating port for suction and evacuation is easily and sealably formed.

By providing the evacuating tube removably introduced into the evacuating port, and by providing a large diameter portion or a taper in the tube, tight contact between the bag and the tube may be achieved on suction and evacuation. The distance between the connecting parts of the evacuating port is decreased from the outer sides towards the inner sides, so that the evacuating port is tapered when in an opened state to further facilitate and assure tight application between the bag and the evacuating tube.

The evacuating tube is made of a material non-adherent to the film material so that it may be inserted easily into the inside of the bag formed of the self-adherent film material and extracted easily after evacuation.

A portable compression packaging kit may be obtained by providing a manual suction pump as an evacuating pump.

Non-adherent members, such as labels, may be provided as opening aids at least at an outer edge portion of the opening part and the evacuating port to facilitate opening the bag.

By forming the main bag body of a non-adherent single-layer film material, or of non-adherent layered films having adherent inner surfaces, the bag may be produced easily at low cost. In one embodiment, only the marginal edges of the bag are formed of a self-adherent film material, while the mid part of the bag is formed of a non-adherent film material. Such construction allows a mid-part of the bag to be opened easily for insertion and extraction of the article into and out of the bag.

It will be seen from above that the present invention provides a self-sealing compression packaging bag which may be used for compression packaging by simple operation, and a compression packaging kit employing the bag. The bag and the kit employing the bag may be small and lightweight. Hence, it may be taken on a trip. Tight sealing may be achieved automatically without the need for special heat compression sealing by simple suction or evacuation.

The bag needs to be non-permeable to air only to the extent required to achieve the objectives of the present invention. Preferred embodiments of the present invention as more specific developments of the fundamental concept of the present invention will be hereinafter explained. The following description is not intended for limiting the invention to these particular embodiments.

DETAILED DESCRIPTION OF PREFERRED EMBODIMENTS

Figure 1:
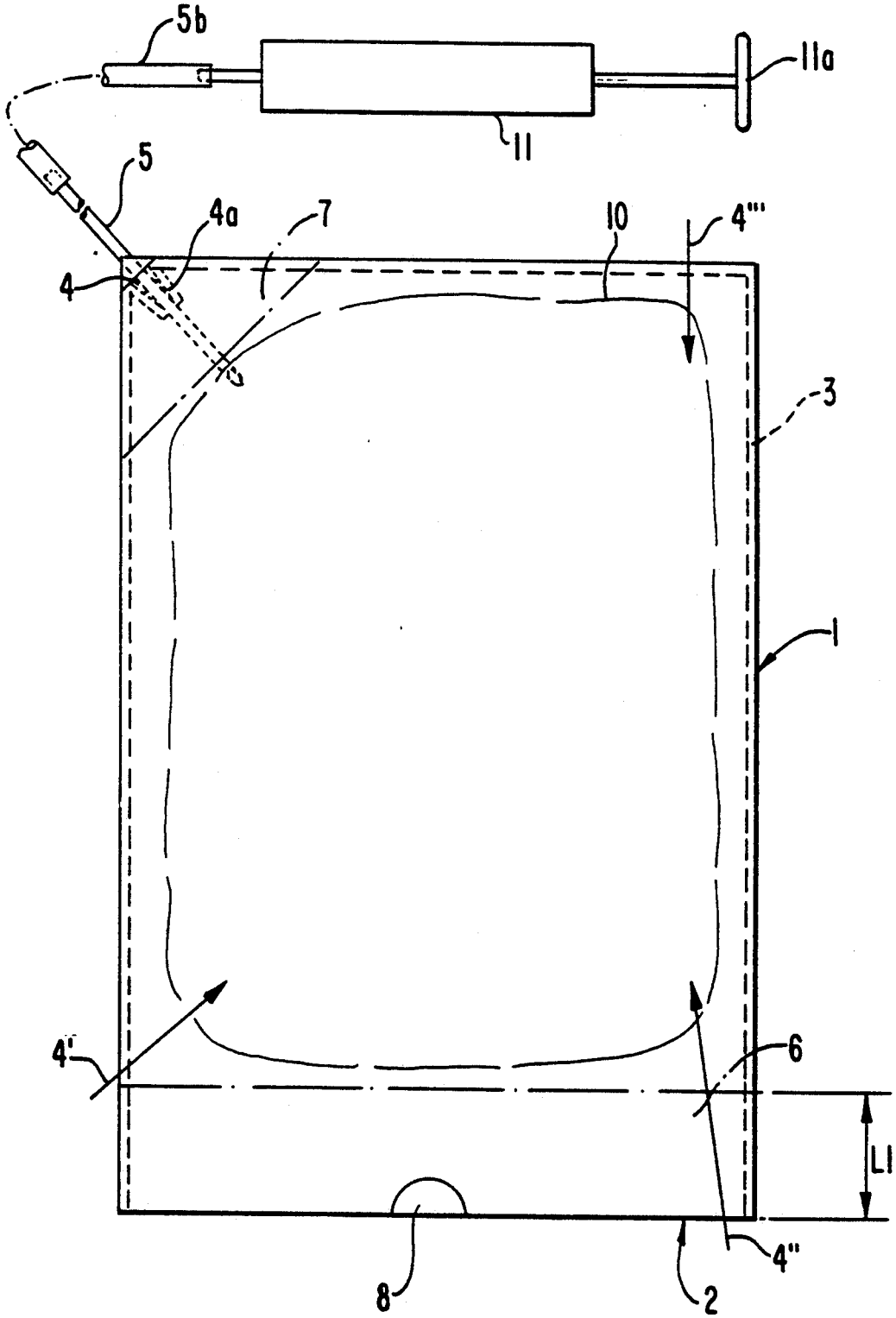
FIG. 1 is a plan view showing an embodiment of the present invention.

FIG. 1 shows a compression packaging bag kit according to an embodiment of the present invention.

Figure 2:
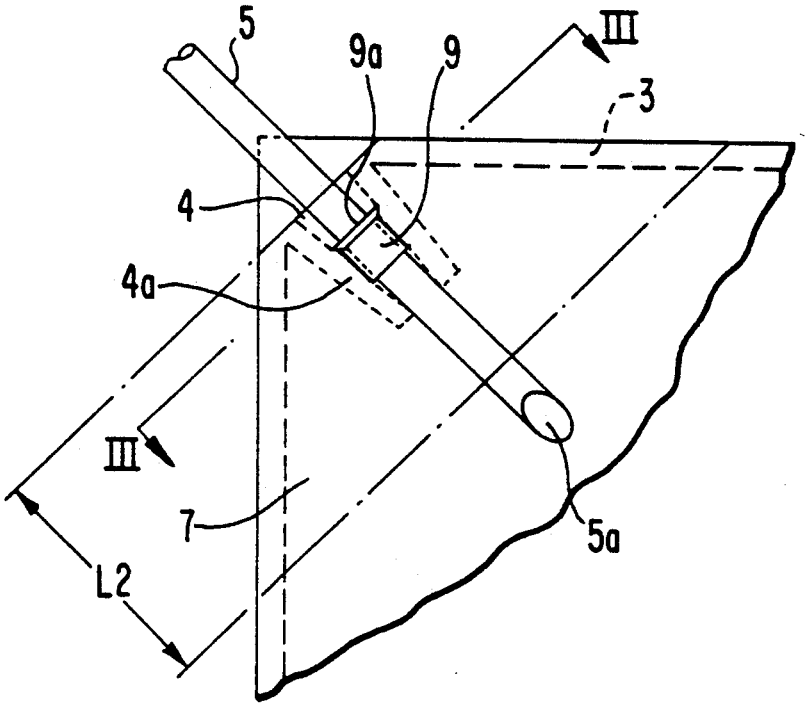
FIG. 2 is an enlarged partial view showing an evacuating port and an evacuating tube.

A self-sealable compression packaging bag 1 is formed of a film material exhibiting self-sealing properties and essentially consists in a rectangular main bag body having as one side an opening part 2 and its three closed. In the embodiment shown, the bag body is composed of bag halves with the three closed sides closed at overlapped edges, or margins, usually by heat compression sealing or high frequency welding. At the upper left corner of FIG. 1, an opening end of an evacuation port 4 is formed by obliquely cutting one of the halves, herein an upper half, as enlarged in FIGS. 2 and 4. The evacuation port 4 communicates with the inside of the bag by inwardly extending a pair of sealed parts 4*a* interconnecting the upper and lower halves of the main bag body, as far as the interior of the bag body, with the outer end of the port being defined by obliguely cutting one of the bag halves. Triangular margin ends of the film remain at the outer end of the evacuating port 4.

Figure 3:
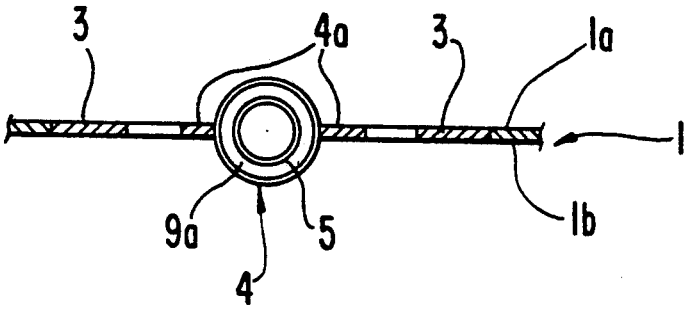
FIG. 3 is a cross-sectional view taken along line III—III of FIG. 2.

An evacuating tube 5 is introduced into the evacuating port 4, with the distal end of the tube 5 reaching the article, such as clothing, contained in the bag. A sleeve 9 is tightly fitted over the tube 5 at a mid part thereof and is introduced into the evacuating port 4 until a larger diameter part or flange 9*a* is intimately contacted with the inner surface of the evacuating port 4. An outer extreme end of the evacuating tube is connected via a connecting hose 5*b* to a manually operated suction pump 11, which is operated by reciprocating a piston, not shown, by means of a knob 11*a*. FIG. 3 shows mainly the evacuating port in cross-section.

The main bag body 1 may be formed of a synthetic film-like material exhibiting self-adherent properties and heat compression sealing or high frequency welding properties. Examples of such film-like material include soft synthetic materials, such as soft polyvinyl chloride (PVC), polyvinylidene chloride or derivatives thereof, usually containing softening agents or plasticizers. Since it is unnecessary for the outer bag surface to be adherent, a layered film material may also be used, if a self-adherent film is disposed at least on the inner surface of the bag body. The film thickness is determined in view of maintenance of non-permeability to air and relative freeness from formation of pinholes. If the film material is PVC, the film thickness may be of an order of 80 to 100 microns or less. Meanwhile, the lesser the film thickness, the higher the bonding tightness.

It is preferred that a margin L1 of the opening part be 20 cm or more and a margin L2 of the evacuating port be about 10 cm towards the inside of the bag from the opening end of the evacuating port 4. For this reason, it is preferred that the evacuating port 4 be provided at a corner. It is also possible that only the allowance area of the tight bonding be self-adherent, in which case the film material may be of a single layer or of a laminated structure.

It is also preferred that the evacuating tube 5 introduced into the port 4 have lubricious properties. The evacuating tube should be non-adherent with respect to the inner surface of the film material of the bag body because then the tube may be more easily introduced into and extracted from the port 4. If the bag body is formed of PVC, a polyethylene resin, for example, may be used for the evacuating tube. The connecting hose 5*b* may be provided optionally in view of ease of handling of the suction pump 11. If the hose is used, its length may be selected appropriately.

The evacuating tube 5 is at least of such a length that its inner end 5*a* reaches an article 10. In other words, it is preferred that the inner end 5*a* be within the inside of the bag beyond the width of a sealing margin 7 in an area of the evacuating port 4 (sealing allowance).

Figure 5A:
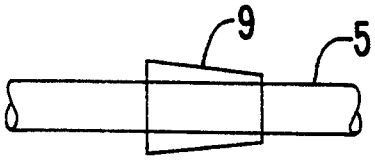
FIGS. 5A and 5B show two modified embodiments of the evacuating tube above and below a center line.
Figure 5B:
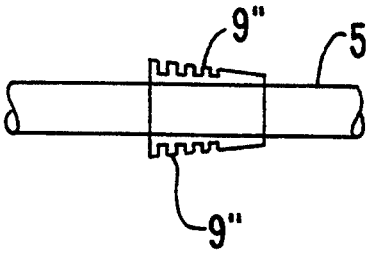

The sleeve 9 fitted over the evacuating tube 5 at a mid part of the length thereof may also be tapered as at 9' as shown in FIG. 5A, or be formed with plural flanges or ring-shape irregularities, as at 9'' shown in FIG. 5B, instead of being formed with the large diameter part or flange 9*a*.

The opening part 2 and the evacuating port 4 may be provided with seal labels 8, 8*a*, as opening aids. The surface of the seal labels should be non-adherent with respect to the inner surface of an opposite film half of the bag body, respectively, for facilitating the opening operation. These seal labels may be colored for marking or identification purposes.

One of the bag halves may be cut obliquely at the corner provided with the evacuating port 4 to facilitate insertion of the tube 5. However, this oblique cutting away may be eliminated if the seal label 8*a* is provided.

The film material of the main bag body needs to exhibit predetermined non-permeability to air. In this case, self-adherent films may be used only in predetermined areas 6, 7, indicated by margins L1 and L2, set aside for sealing. It is noted that only one of the sealing areas 6 and 7 may be formed of an adherent film if such adherent film exhibits sufficient adherent properties with respect to the film material of the bag body.

For example, a compression bag for clothing to be put in a suitcase may be 50 cm wide and 90 cm long with the film material being about 100 microns in thickness. The suction pump 11 may be made of a plastic material so that a kit composed of the bag and the pump may be reduced in weight.

Figure 4A:
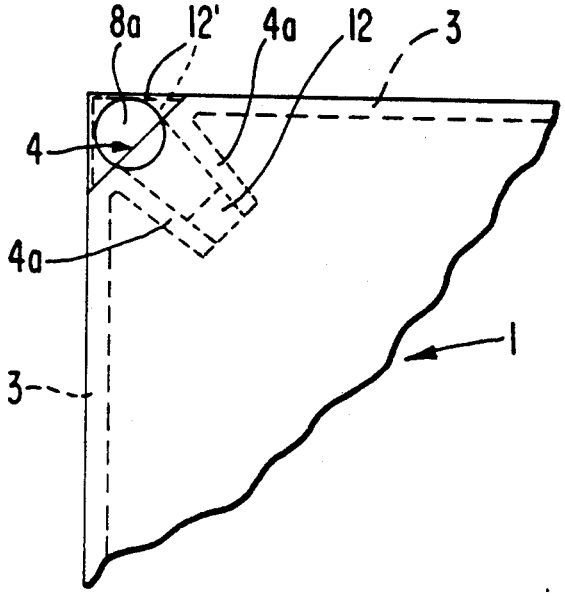
FIGS. 4A and 4B show further embodiments in partial views similar to FIG. 2 with the evacuating tube being omitted.
Figure 4B:
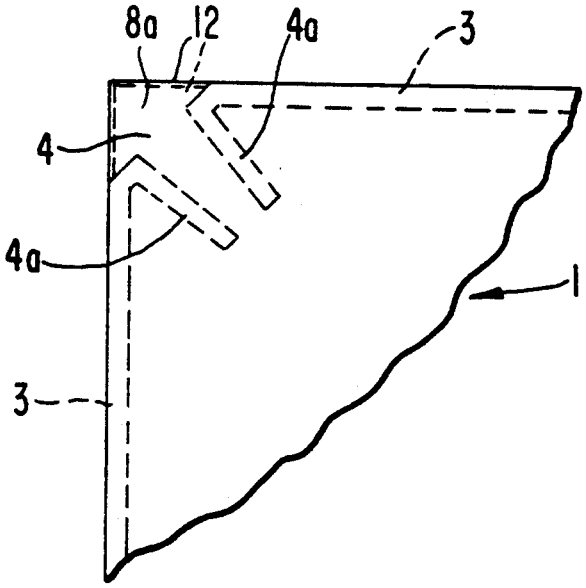

Although the evacuating port 4 is provided obliquely at a corner of the bag body, it may also be provided at some other position taking into consideration the nature of the article to be accommodated and it ease in handling after packaging. For example, the evacuating port may be provided at a position adjacent to a corner of the sealing margin 6 of the opening part 2, as indicated by arrows 4' or 4'', or at a corner of the bottom side parallel to its lateral or longer side, as indicated by an arrow 4'''. A check valve 12 may also be provided at a portion or at the outer end of the evacuating port 4. Such check valve may be of a leaf type by segmenting a part of the film, or by a triangular tab 12' at the corner of the evacuating port 4. In FIGS. 4A and 4B, triangular tabs 12' serve as a check valve provided that there is no seal label 8*a* between the triangular tabs at the corner. After evacuation, tube 5 is removed from the evacuating port 4. Upon removal of the tube 5, a pair of triangular tabs 12',12' are caused to seal-seal to each other being inspired by the vacuum in the bag.

The suction pump 11 may be of a bellows type instead of the piston type as shown.

The suction pump 11, operated manually, may be replaced by some other suction means, such as an electrically operated suction pump or an electric cleaner.

The operation of the compression packaging bag and the compression packaging bag kit according to the present invention will be hereinafter explained.

The bag 1 is opened at the seal label 8 and an article 10 is put into the bag. The evacuating tube 5 is inserted through the port 4 until its distal end 5*a* reaches the article 10. The suction pump 11 is connected to the evacuating tube 5 and, after the film halves have been contacted with each other at the opening part 2, the knob 11*a* is repeatedly pulled to evacuate the inside of the bag body. When contacting the film halves at the opening part 2, it suffices to pull the both ends of the opening part 2 manually along its width for contacting the film halves in a crease-free manner, especially to prevent a crease-extending along the length of the bag body. As evacuation proceeds, the bag causes the article to be compressed, at the same time that the opening part 2 is sealed automatically. When the predetermined compression degree is reached, the evacuating tube 5 is extracted, whereby tight sealing of the evacuation port 4 may be achieved automatically. During extraction, it is sufficient to hold the end of the tube 5 lightly. In this manner, tight sealing is achieved automatically by evacuation without the need for special sealing operations, such as heat compression sealing.

In this state, tight sealing for one to two weeks may be maintained satisfactorily. If need be, suction may be performed at an appropriate time interval, in which case the compressed state may be maintained for an extended period of time.

The film material needs to be of a high quality and free of pinholes. Care should be exercised so that no foreign matter is left in the opening port and in the evacuating port at the time of tight sealing . The bag needs to be large enough so that there is sufficient sealing tolerance 6 at the opening part. The width L1 should be maintained in relation to the size of the article 10.

Sealing of the evacuating tube 5 with respect to the evacuating port 4 during the evacuating operation may be achieved satisfactorily by the above-mentioned abutment of the large diameter portion 9*a* of the sleeve 9 against the inner surface of the evacuating port 4. The clothing, for example, may be compressed to about one-third or less of its original volume. Although the compression packaging bag of the present invention is mainly intended to be used with small sized articles or articles with a small volume, depending on the capacity of the manual pump, it may naturally be adapted for use with larger articles by using a larger pump. Meanwhile, compression packaging may be achieved in a small sized bag by sucking with the user's mouth and thus, a pump is not needed. In this case, the hose may be bent 180° after suction to be used as a valve. A pinch valve may also be provided at a mid part of the hose.

The present invention may be used not only to store clothing but also to temporarily store food in vacuum (so-called vacuum packing). It is noted that to obtain a high vacuum a higher performance suction pump should be used and no foreign matter should be permitted in the sealing margin during evacuation.

It should be noted that modifications obvious in the art may be done without departing from the gist and scope of the invention as herein disclosed and claimed as appended.

What is claimed is:

1. A self-sealing compression packaging bag comprising:

an opening part and an evacuating port, wherein said bag is comprised of a film material exhibiting self-adherent properties as sealing means on at least an inner surface of said opening part and in a portion of said evacuating port at a length sufficient to maintain self-sealing.

2. A self-sealing compression packaging bag as claimed in claim 1, said bag further comprising a main bag body comprising a film material exhibiting self-adherent properties.

3. A self-sealing compression packaging bag as claimed in claim 1, said bag further comprising a main bag body comprising a laminated film material having a film layer, wherein an inner surface of said film layer exhibits self-adherent properties.

4. A self-sealing compression packaging bas as claimed in claim 1, wherein said evacuating port is open on an outer edge of said bag and extends into the interior of said bag, said evacuating port is openably defined between a pair of sealed parts of bag halves formed from both bag sides.

5. A self-sealing compression packaging bag as claimed in claim 1, wherein the distance between the sealed parts of said bag halves at said evacuating port is diminished from the outer side towards the inner side.

6. A self-sealing compression packaging bag as claimed in claim 1, wherein non-adherent members are provided as opening aids at least at outer edge portions of said opening part and said evacuating port.

7. A self-sealing compression packaging bag as claimed in any of claims 1 to 6, further comprising an evacuating tube which is removably introduced into said evacuating port.

8. A self-sealing compression packaging bag as claimed in claim 7, wherein said evacuating tube is non-adherent with respect to said film material.

9. A self-sealing compression packaging bag as claimed in claim 7, wherein said evacuating tube is provided with a large diameter portion or a tapered portion tightly engageable with said evacuating port.

10. A self-sealing compression packaging bag as claimed in claim 4, wherein said evacuating port terminates leaving triangular margin ends of the film material at a corner of said bag.

11. A compression packaging bag kit comprising:

the self-sealing compression packaging bag as claimed in claim 7 and an evacuating pump.

12. A compression packaging bag kit as defined in claim 11, wherein said evacuating pump is a manual suction pump.

* * * * *

UNITED STATES PATENT AND TRADEMARK OFFICE

CERTIFICATE OF CORRECTION

PATENT NO. : 5,333,736

DATED : August 2, 1994

INVENTOR(S) : Yoshihisa KAWAMURA

It is certified that error appears in the above-identified patent and that said Letters Patent is hereby corrected as shown below:

On title page, item [54], the title should read:

--SELF-SEALING COMPRESSION PACKAGING BAG AND COMPRESSION PACKAGING BAG KIT--

Signed and Sealed this

Eighth Day of November, 1994

Bruce Lehman

*Attest:*

BRUCE LEHMAN

*Attesting Officer*

*Commissioner of Patents and Trademarks*